US006179139B1

(12) United States Patent
Heilman

(10) Patent No.: US 6,179,139 B1
(45) Date of Patent: Jan. 30, 2001

(54) TAMPER-INDICATING CLOSURE

(76) Inventor: Robert John Heilman, 13801 Logan Dr., Orland Park, IL (US) 60467

( * ) Notice: Under 35 U.S.C. 154(b), the term of this patent shall be extended for 0 days.

(21) Appl. No.: 09/274,930

(22) Filed: Mar. 24, 1999

(51) Int. Cl.[7] ..... B65D 41/16; B65D 50/00; B65D 51/14

(52) U.S. Cl. ..... 215/230; 215/317; 215/901

(58) Field of Search ..... 215/230, 366, 215/365, 203, 347, 350, 351, 317, 901; 220/214

(56) References Cited

U.S. PATENT DOCUMENTS

| | | | | |
|---|---|---|---|---|
| 4,531,649 | * | 7/1985 | Shull | 215/347 X |
| 4,533,059 | * | 8/1985 | Kapolas et al. | 215/230 |
| 4,721,219 | | 1/1988 | Dullabaun . | |
| 4,765,498 | * | 8/1988 | Rafferty | 215/230 |
| 4,793,500 | | 12/1988 | Harding . | |
| 4,877,143 | * | 10/1989 | Travisano | 215/230 |
| 5,022,545 | | 6/1991 | Carson . | |
| 5,092,477 | * | 3/1992 | Johnson, Jr. et al. | 215/230 |
| 5,119,963 | | 6/1992 | Heilman . | |
| 5,190,175 | * | 3/1993 | Schmidt | 215/230 |
| 5,289,929 | | 3/1994 | Heilman . | |
| 5,341,947 | * | 8/1994 | Rosse et al. | 215/230 |
| 5,474,194 | | 12/1995 | Heilman . | |
| 5,839,592 | * | 11/1998 | Hayes | 215/230 |
| 5,884,788 | * | 3/1999 | Wilde | 215/230 |
| 5,896,686 | * | 4/1999 | Howes | 215/230 X |

* cited by examiner

*Primary Examiner*—Allan N. Shoap
*Assistant Examiner*—Niki M. Eloshway

(57) ABSTRACT

This relates to the provision of a button type closure with a tamper-indicating element that visually indicates when a container has been opened. A deflectable button on an actuator panel is utilized to fracture a disk of brittle material situated between the button and a rigid transparent plastic holder into which the actuator panel and brittle disk are inserted. The plastic holder not only carries the actuator panel and brittle disk, but it also has provisions to hold the deflectable button in its down position by pressing the down button tightly against a rib on the underside of the holder, thus holding the deflectable button in the down position before the closure is applied to a container. When the closure is applied to a container the container finish deforms a region on the actuator panel adjacent to the button, decreasing the overall height of the actuator panel, so that after application of the closure to a container, only the container finish is pressing the down button tightly against the rib on the underside of the holder, thus continuing to prevent the button from popping up. Upon opening the package, the separation of the actuator panel and container finish permits the deformed actuator panel and the transparent holder to separate also, releasing the down button, allowing it to flip back to its up position, striking the brittle disk and fracturing it, thus producing an irreversible indication that the package has been opened.

25 Claims, 7 Drawing Sheets

TAMPER-INDICATING CLOSURE

BACKGROUND FIELD OF THE INVENTION

This invention relates in general to new and useful improvements in closures of the type utilizing a normally convex shaped button to activate an irreversible tamper-indicating feature when the closure is removed from a container.

BACKGROUND DISCUSSION OF PRIOR ART

Metal closures with vacuum actuated buttons are used extensively by the food industry to seal vacuum packed food containers. The original purpose of the button was to alert the packer and the consumer if the vacuum inside the container had been lost since the package was filled and sealed. If the vacuum were lost, the button would pop up, indicating possible product spoilage. However, after several product tampering incidences where packages were opened, the contents adulterated, and the package resealed, it became obvious that something more than just the vacuum actuated button would be needed to indicate to the purchaser whether the package had been previously opened. The vacuum actuated button alone can not do this because it is easy to restore the vacuum in a package that has been opened, by heating the contents of the package and reapplying the closure. The contents of the package shrink as they cool, resulting in the formation of a vacuum in the package that pulls the button back down. To overcome this shortcoming, a number of inventions have been devised that use the energy released as the button pops up to produce an irreversible change to an indicator. The indicator is typically attached to the button, or is in close enough proximity to it that the button interacts with the indicator when it pops up, causing a visible change to the indicator to alert the consumer that the package may have been opened. These inventions rely upon a vacuum to pull and hold the button down until the vacuum is released when the package is opened. Some of these inventions require that the packer apply the indicating element after the vacuum formed inside of the package pulls the button down. Others such as U.S. Pat. No. 5,474,194 to Heilman et al. rely on a flexible, partially cured coating that is applied by the closure manufacturer. After the closure is applied to a container and the button pulled down by the vacuum formed inside, the packer must subject the coating to ultra violet light or other energy source in order to fully cure the coating. When the coating is fully cured it becomes so brittle that it fractures when the package is opened and the button pops up. These coating materials are expensive, cure slowly, and require the packer to add additional equipment to apply or cure them. In addition, by holding the button down when the package is opened, it is possible to adulterate the contents, reheat them, and then reapply the closure without the button ever popping up and fracturing the coating.

For a vacuum actuated button to be pulled down and stay down, some minimum pressure differential must be maintained between the pressures outside and inside the package. Even when this pressure difference is maintained, it is possible for the button to pop up momentarily if the package is handled roughly. For a closure with a button and no indicator element this is not a problem since the button simply returns to its down state when the disturbance ends. However, if there is an irreversible indicator element associated with the button that changes when the button pops up, these momentary button excursions become a problem since they produce a false indication that the package has been opened. This problem is magnified when the package is brought to a higher elevation than where it was sealed, since the atmospheric pressure is lower at a higher elevation, thus reducing the differential between the pressures inside and outside the package.

Packages in which only a slight, or no vacuum normally exists, such as those for dry products, over the counter medications, still drinks and hot filled drinks in semi rigid containers, cannot use a vacuum actuated button closure to activate a tamper-evident feature since there is insufficient vacuum for the button to function. To indicate tampering, many containers for these products rely on plastic closures with integral breakable bands attached to the bottom of the skirt of the closure by thin plastic bridges. When applied properly, the band locks under a bead on the container finish, so that when the closure is removed, the bridges and/or the band breaks. If the dimensions of the closure and/or the container are not maintained within certain narrow limits, the closure will not function properly. If the bead on the container finish happens to be at the high end of its size tolerance and the closure dimensions at the low end of their size tolerance, it is often impossible to apply the closure without breaking the bridges or band. Conversely, if the beads on the bottle finish are small and the closures large, the band will not break when the closure is removed and instead will remain intact and be removed along with the rest of the closure. Even when the finish and closure sizes are ideal, the closure can often be removed without breaking the band by intentionally heating the plastic until it softens.

These bands are difficult to mold and require complex, high maintenance mechanisms in the mold to allow the closure to be removed from the mold. The bridges and band are delicate, requiring extra care when setting up a capping machine in order not to break the bands or bridges when the closure is applied to the container. At times this requires slowing the speed of the capper at the expense of production.

Another type of tamper-evident device employed for low or non-vacuum packages is the shrink band or tape seal, whereby the packer applies a film or tape over both the skirt of the closure and the neck of the container after filling and sealing the package. To open the package the tape must first be slit at the juncture of the cap and container, or be removed completely and discarded. However, these devices are costly and difficult for the packer to apply to the package, causing reduced closing speeds.

Because tamper bands and tape seals are exposed, they can be readily manipulated and are easily defeated by one intent on breaching the package. Because they do not provide an obvious indication and are located on the side of the package, the consumer can easily overlook their condition, or even not notice whether they are present at all.

SUMMARY OF THE INVENTION

In view of the foregoing, it is proposed:

a) To provide a closure with a deflectable button and a tamper-indicating member that will be irreversibly affected by the return of the button to its up position when the closure is removed from a container, producing a clear vision indication that the container has been opened.

b) To provide a closure with a button that is not susceptible to popping up prematurely such as when the package is brought to a high elevation, is accidentally dropped, or is subjected to rough handling during shipment.

c) To provide a closure with a button that functions in the intended manner not only on packages in which an internal vacuum exists, but also on packages in which little or no vacuum exists, and even on packages in which a positive pressure exists.

d) To provide a tamper-evident closure in which the tamper-indicating element is difficult to access, and is secure from attempts to thwart it by potential tamperers.

e) To provide a tamper-evident closure that is reliable and not affected by normal material and dimensional variations.

f) To provide a tamper-evident closure whose elements are inexpensive, and are simple to manufacture and assemble.

g) To provide a tamper-evident closure whereby all elements of the closure are completely assembled as received by the packer, and that other than applying the closure to a container, no action is needed by the packer to activate the tamper-evident feature.

h) To provide a tamper-evident closure that does not require painstaking set-up of a capping machine for successful application, nor does it require that the speed of the capping machine be reduced for proper application of the closure.

With the above and other objects in view that will hereinafter appear, the nature of the invention will be more clearly understood by reference to the following detailed description, the appended claims, and the several views illustrated in the accompanying drawings.

DESCRIPTION OF DRAWINGS

FIG. 4 is a vertical sectional view through the center of the proposed closure, also showing a container which the closure would be used on.

DESCRIPTION OF PREFERRED EMBODIMENTS OF THE INVENTION

Figure 1:
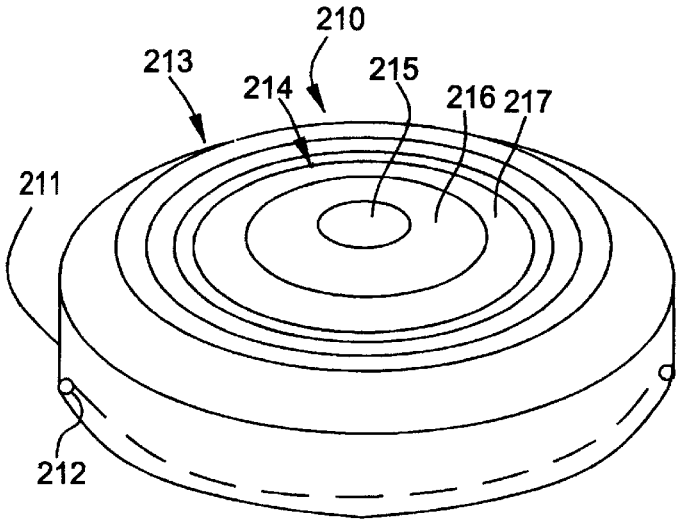
FIG. 1 PRIOR ART
FIG. 1 is a top perspective view of a conventional vacuum closure incorporating a vacuum actuated button.
Figure 2:
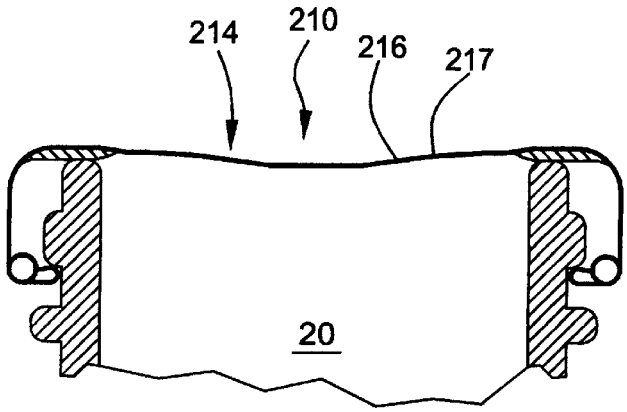
FIG. 2 PRIOR ART
FIG. 2 is a vertical sectional view taken through the center of the closure of FIG. 1 as applied to a container, but with the button pulled down by a vacuum formed within the container.
Figure 3:
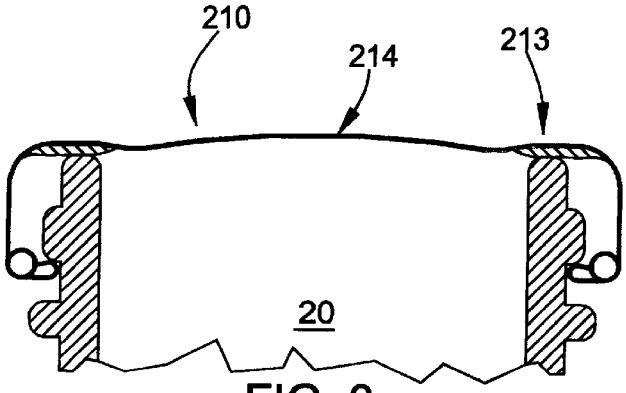
FIG. 3 PRIOR ART
FIG. 3 is a vertical sectional view taken through the closure of FIG. 1 as applied to a container, but with the button in its up position, indicating a lack of vacuum in the package.

Referring now to the drawings in detail, reference is first made to FIG. 1–3 wherein is illustrated a conventional type of closure generally identified by the numeral 210. As shown in FIG. 1, the closure 210 includes a skirt 211 having at the lower end thereof a curl 212. At its top, the skirt 211 encircles an end panel generally defined by the numeral 213. The end panel 213 is configured to define a central button 214, which typically consists of a central circular portion 215 and two annular hinged portions 216 and 217.

As shown in FIG. 2, when the closure 210 is applied to a container 20 and a vacuum is formed within the container 20, the vacuum draws the button 214 downwardly by a hinging action in annular portions 216 and 217. As shown in FIG. 3, when the vacuum is removed from within the container 20, such as by loosening the closure 210, stored energy within the button 214 and the end panel 213 causes the button 214 to snap back to its up position.

As previously described, the closure 210 as illustrated in FIG. 1–3 is well known prior art. In accordance with this invention, the closure of FIG. 1–3 is modified and becomes one of the components referred to with the numeral 110 of the proposed closure, generally referred to with the numeral 100. In the descriptions that follow, the term "deflectable" is defined as a temporary change to the shape of a member of the invention that is produced by an external force acting on the member. Once the force is removed, the shape of the member returns to its original form. The term "deformable" refers to a permanent change in the shape of a member that is produced by the application of an external force, such that upon removal of the external force, the member does not return to its original shape.

Figure 4:
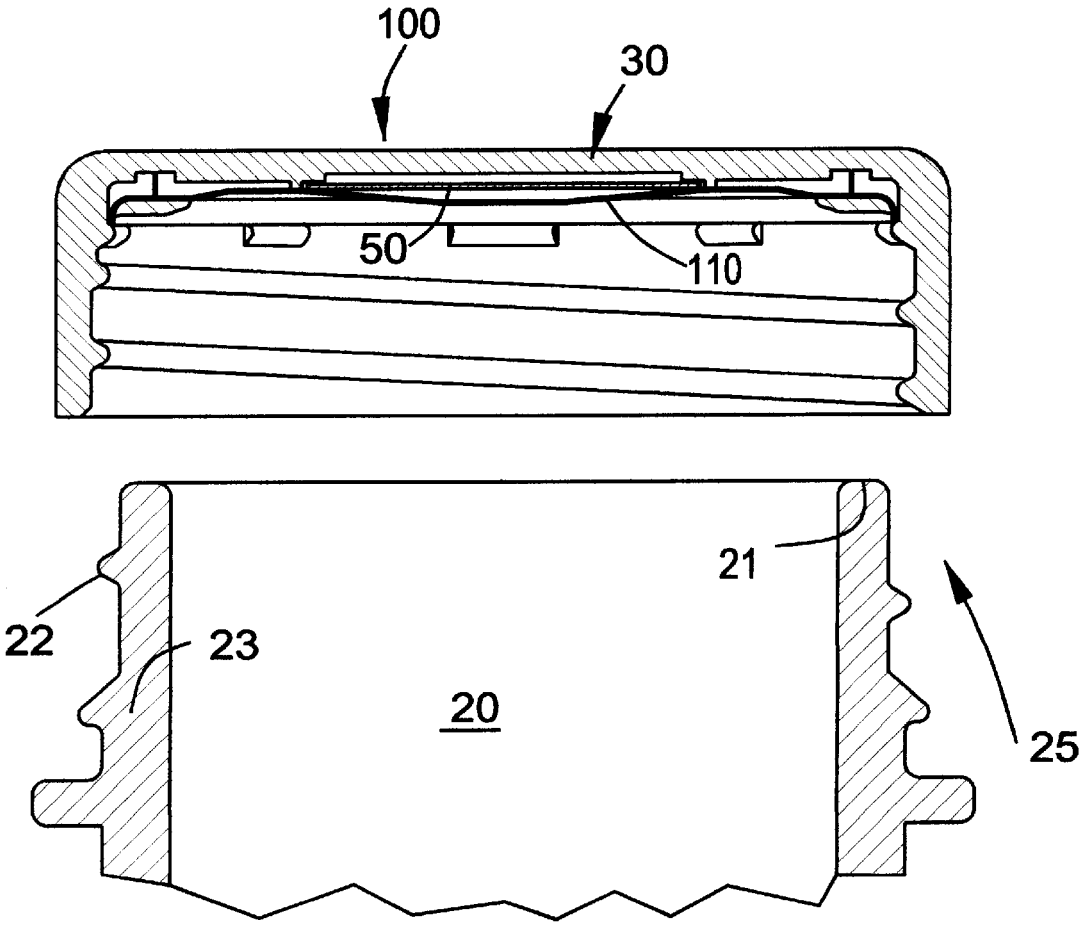

Referring to FIG. 4, the closure 100 consists of an actuator panel 110, and a tamper-indicating element referred to with the numeral 50, both inserted into a rigid translucent or preferably transparent plastic holder referred to with the numeral 30. The container to which the closure 100 is applied is generally referred to with the numeral 20. The container finish is generally referred to with the numeral 23, with the sealing surface referred to as numeral 21, and the helical thread for engaging the closure, referred to as numeral 22. The sealed package consisting of the closure 100, the container 20 and the contents is generally referred to with the numeral 25.

Figure 5:
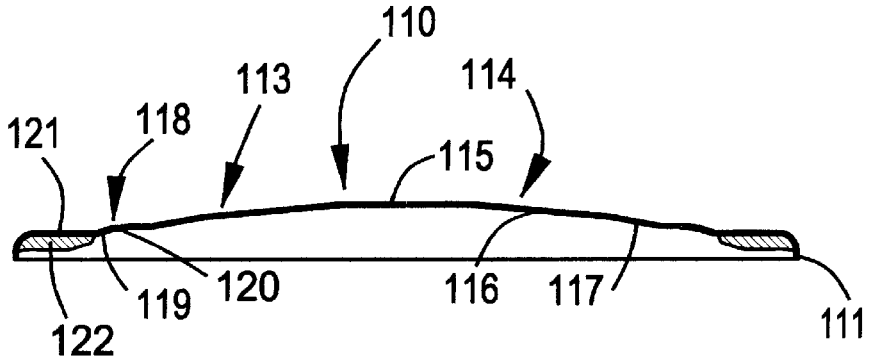
FIG. 5 is a vertical sectional view through the center of an actuator panel of the proposed closure showing a deflectable button in its up position and a deformable transition section sloping downward and outward from the center.

Referring now to FIG. 5, the actuator panel 110 is preferably made from a tin mill product such as black plate, tinplate, or tin free steel, although it could be made from aluminum or a high stiffness thermosetting or thermoplastic material. It comprises a shallow vertical skirt 111 at the edge of a circular top panel 113. A deflectable button 114 located at the center of the top panel 113 slopes outward and downward from a flat circular section 115 at the center, generally through at least one and preferably two sloping sections 116 and 117. If an external force is applied to the button 114 that makes the normally up, convex button flip to a down or concave position, the button will return to its original up position when the external force is removed.

Encircling button 114 is a bi-stable deformable region 118 typically consisting of at least one and preferably two hinged annular regions 119 and 120 that during assembly of the components slope outward and downward from the center of the actuator panel 110. The bi-stable region 118 is initially formed with annular regions 119 and 120 sloping outward and upward. By reforming them to an outward and downward configuration, residual stresses are formed within the deformable region 118 that result in its bi-stable behavior, such that it can be moved from one position to another and will remain in the position in which it was last moved.

Connected to the outer edge of the sloping annular region 119 is a flat annular region 121 that in turn terminates with the shallow vertical skirt 111. On the underside of the actuator panel 110, confined by the skirt 111 and the flat annular region 121, a resilient sealing compound 122 is deposited to provide a seal between the actuator panel 110 and the container.

Figure 6:
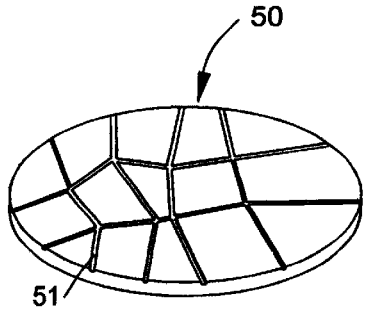
FIG. 6 is a perspective view of an irreversible tamper-indicating member for the proposed closure, looking at the detail of its underside.

FIG. 6 is a perspective view of the underside of a thin, disk shaped tamper-indicating element referred to with numeral 50. In the preferred embodiment, disk 50 is formed by compacting a mixture of powdered materials comprising calcium carbonate, talc, rosin, or other similar inert filler material with a binder such as paraffin wax, and a suitable colorant to produce a sharp contrast to the color of the coating on the button. The mixed powders are compacted using pressure adequate to produce a disk that is strong enough to be handled, and yet brittle enough to be broken by the application of a relatively small force such as that produced when the button pops up and impacts it. To control the size of the fractured particles and enhance the fracturability of the brittle disk 50, a series of interconnecting shallow channels or depressions 51 are formed on the underside of disk 50.

Figure 7:
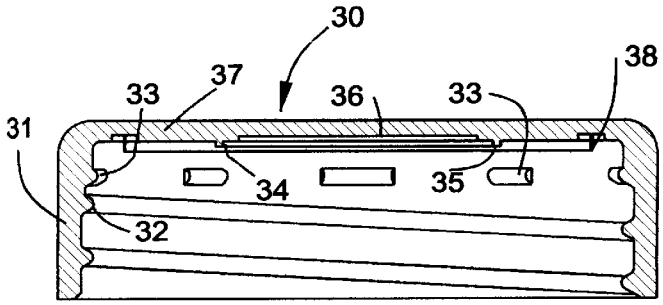
FIG. 7 is a vertical sectional view through the center of a holder member of the proposed closure.

Referring now to FIG. 7, the holder 30 is preferably injection or compression molded from nucleated polypropylene or other translucent or preferably transparent thermoplastic material. It has a circular top panel 37 with a vertical cylindrical skirt section 31 extending downward from the outer edge of top panel 37. Two concentric circular recesses 34 and 36 are located on the underside of top panel 37 at its center. The larger recess 34 has a diameter that is smaller than the outer diameter of button 114 of FIG. 5, but larger than the diameter of disk 50 of FIG. 6. The depth of recess 34 is slightly greater than the thickness of disk 50, such that the disk 50 can be inserted into recess 34 without protruding. The diameter of the smaller recess 36 is less than the diameter of disk 50, and recess 36 is deep enough to allow disk 50 to deflect a sufficient amount that it will fracture when acted upon by button 114 of FIG. 5.

The outer edge of recess 34 defines one edge of a downward projecting rib 35 that is intended to press against the outer sloping region 117 of button 114 of FIG. 5, acting as a means to hold button 114 in a down position. A thin web 38 projects downward from an annular recess formed into the top of a channel formed by the outside surface of projecting rib 35, the underside of top panel 37 and the skirt 31.

One or more helical threads 32, intended to engage matching helical threads on the neck of the container in which the product is placed, project inwards from the inner wall of cylindrical skirt 31.

Also projecting inwards from the wall of skirt 31, above the helical threads 32, are a plurality of arcuate retaining lugs 33, generally equally spaced around the circumference of skirt 31. The inside diameter of the arcuate lugs is smaller than the outside diameter of actuator panel 110 of FIG. 5, so that when the actuator panel 110 is inserted past the lugs 33, the actuator panel 110 is positively retained. The vertical position of lugs 33 is such that actuator panel 110 with bi-stable region 118 positioned outward and downward, is disposed upward by the lugs 33 so that the outer edge 117 of button 114 of FIG. 5 is pressed tightly against rib 35. Although the preferred embodiment specifies arcuate shaped lugs, many possible geometry's are possible, from a continuous inwardly projecting bead to small dot like projections. Any shape that allows the actuator panel 110 to be inserted into the holder 30 and then disposes the actuator panel 110 upward to press the button 114 tightly against rib 35 will suffice. The function of these various elements will become apparent during the description of the function of the closure that follows.

Figure 8:
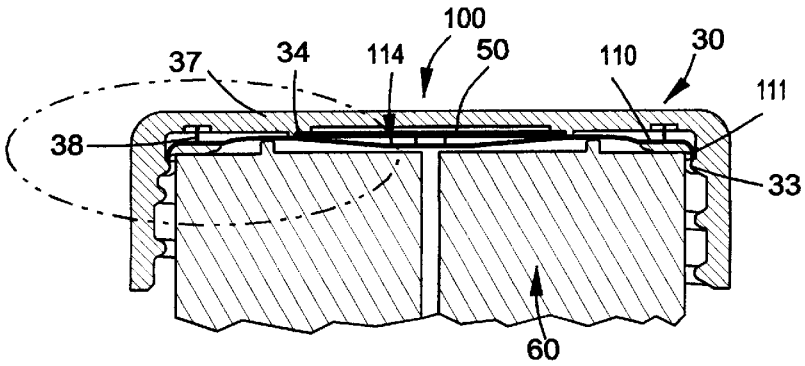
FIG. 8 is a vertical sectional view of the assembled components and the top part of an assembly fixture used to assemble the closure components.

FIG. 8 shows the components of the closure 100 and a fixture 60 that is used to assembly them. For assembly, the plastic holder 30 is inverted and the brittle indicator disk 50 is placed into recess 34 on the underside of top panel 37. The actuator panel 110 is then placed onto the end of assembly fixture 60 and the button 114 depressed. A vacuum is then applied through the assembly fixture 60 to the underside of the actuator panel 110 to hold the button 114 down. If the actuator panel 110 is made of steel, a permanent or electromagnet can be used in place of, or along with, the vacuum to hold the button 114 down. The assembly fixture 60 is then used to insert the actuator panel 110, with button 114 held down, into holder 30 until the edge of the skirt 111 on the actuator panel snaps over the retaining lugs 33 and the thin web 38 contacts the top of the actuator panel 110.

Figure 8A:
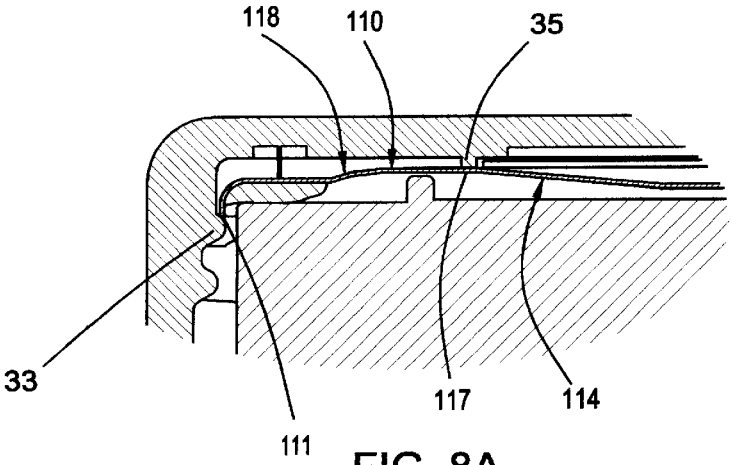
FIG. 8A is an enlarged fragmentary view of the assembled components of FIG. 8, showing in greater detail the bi-stable deformable section in a downward, outward position.

As is shown in greater detail in FIG. 8A, with bi-stable region 118 positioned outward and downward, the lugs 33 contact the edge 111 of actuator panel 110 disposing the actuator panel upwards and pressing the outer sloping section 117 of button 114 tightly against rib 35 on the underside of the holder 30. The force applied to the button 114 by the rib 35 holds the button in its down position even after the vacuum has been relieved and the closure 100 removed from the assembly fixture 60. It is in this form that the closure 100 is sent to the packer.

Figure 9:
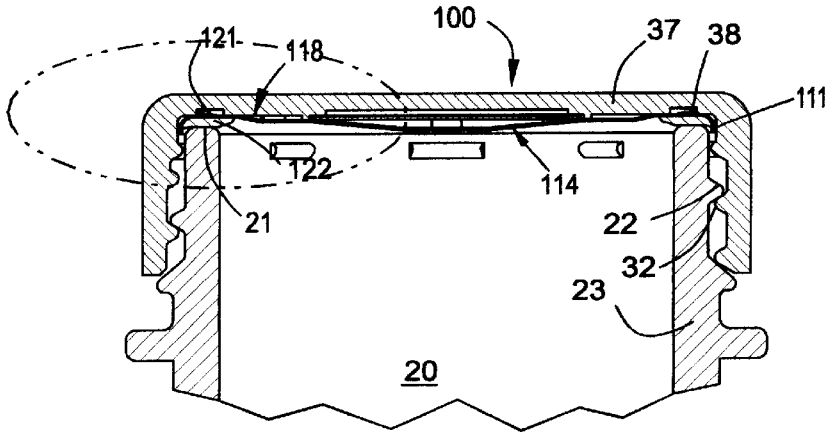
FIG. 9 is a vertical sectional view through the center of a sealed package, showing the proposed closure after the closure is applied to a container and the deformable transition section of the button panel has been displaced to an upward outward position.

As is shown in FIG. 9, when the closure 100 is applied to a container 20 the helical threads 32 and 22 co-act to bring the closure 100 and container 20 together to effect a secure seal. In the process, the outer annulus 121 and skirt 111 are moved upwards by the action of the sealing surface 21 of the container finish 23 pushing on the compound 122. To allow this movement, bi-stable region 118 changes from an outward-downward position to an outward-upward position through the hinging action of bi-stable region 118. When outer annulus 121 moves upward, it deflects the thin web 38 that projects from the underside of the top panel 37 causing it to deflect. The restraining force that the web 38 applies to the outer annulus 121 prevents the bi-stable region 118 from abruptly snapping from a down to an up position. The web 38 thus dampens the movement of bi-stable region 118 keeping it in control so that the button 114 will not pop up during this transition.

Figure 9A:
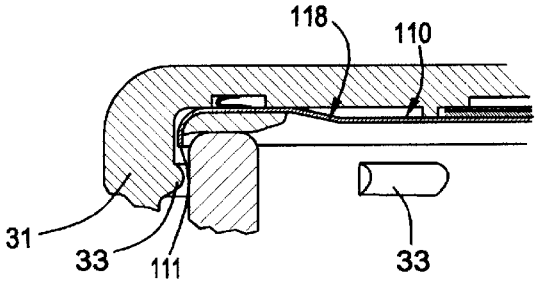
FIG. 9A is an enlarged fragmentary view of the bi-stable deformable section of FIG. 9 positioned upward and outward.

As is shown in greater detail in FIG. 9A, because the bi-stable deformable region 118 has been repositioned making the overall height of the actuator panel shorter, the edge of the skirt 111 on the actuator panel 110 no longer contacts lugs 33 on the skirt 31.

Figure 10:
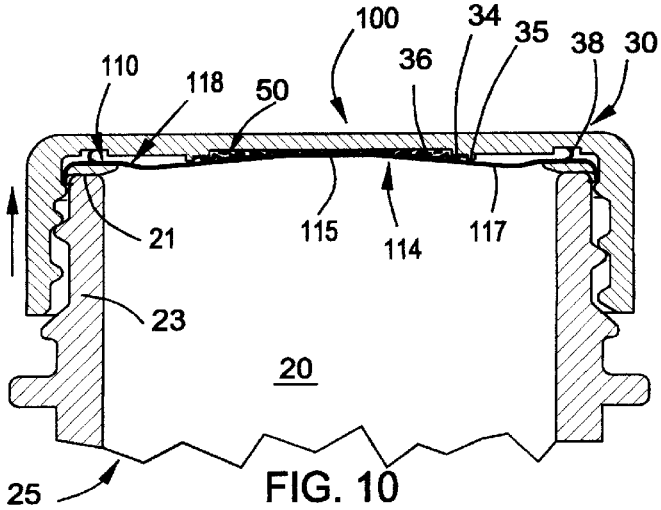
FIG. 10 is a vertical sectional view through the center of the package of FIG. 9 after the closure has been removed to a point where the button has popped up and fractured a brittle tamper-indicating disk.

FIG. 10 shows the package 25 as it is being opened and the closure 100 has been loosened slightly from the container 20. As the closure 100 is unscrewed, it moves axially up the finish 23 of the container 20 as is indicated by the arrow in the figure. Thus, the force applied by the sealing surface 21 to the actuator panel 110 diminishes. With the bi-table deformable section 118 of the actuator panel 110 last repositioned upward and outward, the rib 35 can only hold the button 114 down as long as the sealing surface 21 pushes against the actuator panel 110. As the closure is removed, the web 38 pushes the actuator panel 110 down, causing the rib 35 and the button 114 to separate until the button 114 pops up due to its stored energy. Because of the arched convex shape of the up button 114, the center portion 115 moves upward a much greater distance than the outer annulus 117. Since the brittle indicator disk 50 is held in the recess 34 just above the down button 114, the center 115 of the button strikes the underside of the brittle disk 50 when the button pops up. Since the recess 34 in the underside of the holder 30 is restraining the edge of the brittle disk 50, the center of disk 50 deflects into the recessed region 36 until the disk 50 fractures along the recessed grooves 51 of FIG. 6.

Figure 11A:
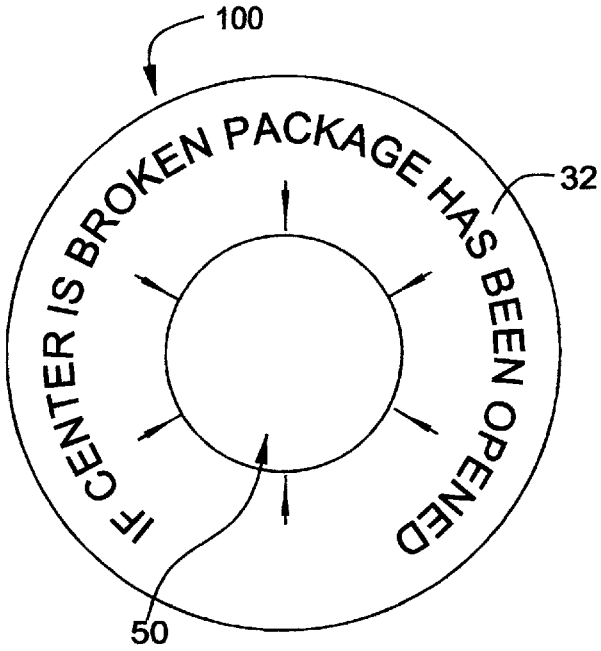
FIG. 11A and FIG. 11B are top views of the aforementioned closures with brittle disk tamper-indicating elements, showing respectively the brittle indicator disk before and after it has been fractured.

FIG. 11A shows the top of the proposed closure 100 when the brittle disk 50 is intact. The view shows a printed message on the top panel 32 indicating how the tamper-indicating closure 100 functions.

Figure 11B:
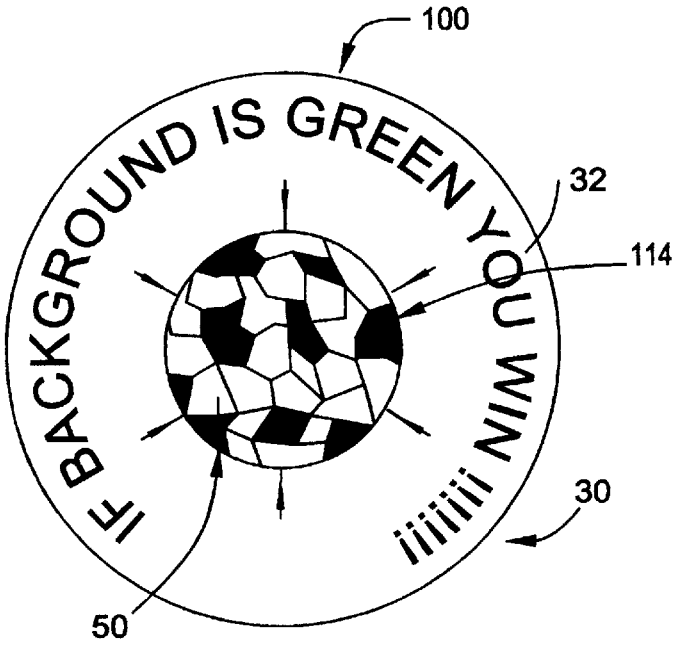

FIG. 11B is a top view of the closure 100 after the package has been opened and the button has interacted with the tamper-indicating element. Since the center of plastic holder 30 is translucent or transparent, the fractured brittle disk 50 and the underlying contrasting coating on the button 114 of FIG. 10 can be clearly seen, indicating that the package has been opened. In this figure the top panel 32 has been printed to provide a promotional message.

Figure 12:
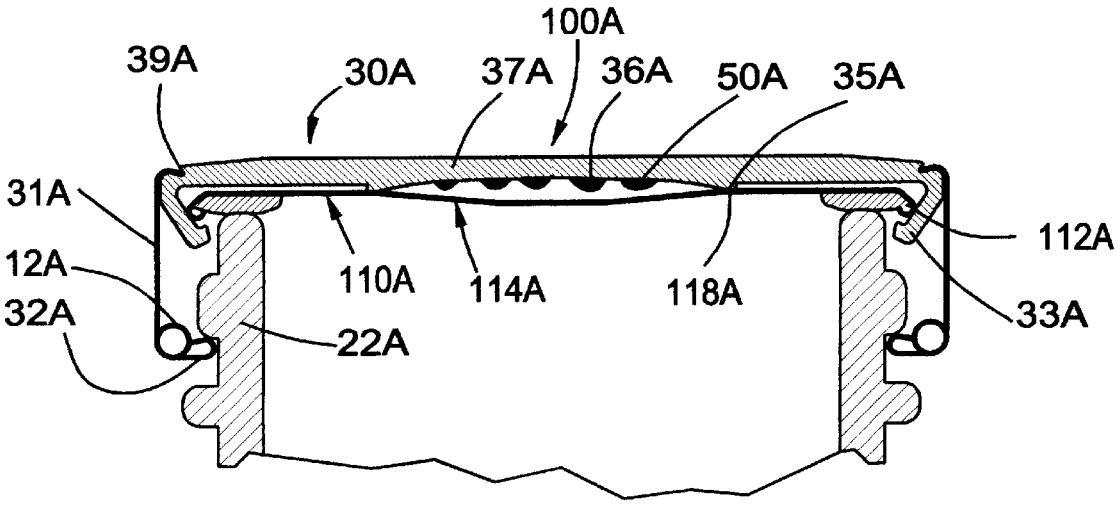
FIG. 12 is a vertical sectional view of another embodiment of the proposed closure after the components of the closure have been assembled, the assembly fixture removed, and the closure applied to a container in which an internal vacuum exists.

FIG. 12 shows another embodiment of the proposed closure for use on packages in which a vacuum exists. Since many vacuum packed products must undergo high temperature processing to render the food product microbe free, this embodiment also includes a 2-piece holder member 30A suited for high temperature use. The skirt 31A of the 2-piece holder is made by deep drawing steel or aluminum sheet to form a shell with an integral button panel 110A having at its center a button 114A that is deflectable from an up to a down position. The button panel 110A is then removed from the center of the drawn shell by a blanking operation and a tight curl 112A formed on the edge of the button panel 110A. Thus, a button panel with a deflectable button 114A that performs in the same manner as the button of the initial embodiment of FIG. 5 is produced. Because of the presence of a vacuum inside the package, a deformable bi-stable region is not needed on this button panel as will become obvious in the description that follows.

An injection molded translucent or preferably transparent top holder insert 37A, made from a heat resistant thermoplastic such as polycarbonate is inserted into the opening left in the top of the drawn shell when the button panel 110A was removed. The top inner edge 39A of the skirt 31A snaps into a recess provided on the top of the insert 37A, securely connecting the two pieces. The bottom edge of the skirt 31A is then curled inward and a series of lugs 32A formed into the curl 12A. The purpose of the lugs 32A is to engage cam surfaces on the finish 22A of the glass container, in order to effect a secure seal between the closure 100A and the container.

This embodiment also utilizes an alternate irreversible tamper-indicating element that may be used instead of the brittle disk previously described. For this tamper-indicating element, the center of the underside of the plastic holder insert 37A is formed to a concave arched shape 36A that closely matches the shape of the button 114A when the button 114A is in its up position. Prior to assembly of the components, an ink jet printer or other means are used to deposit a thick, highly viscous, non-drying ink 50A to the concave surface 36A on the underside of holder insert 37A. Any pattern consisting of letters, numbers or geometric shapes can be deposited to produce a word or icon on the underside of surface 36A. If desired, multiple print heads can be used to apply multiple colors.

After applying and curing a sealing compound at the outer periphery of the underside of the button panel 110A, the panel 110A is placed onto an assembly fixture as in the initial embodiment, and the button 114A depressed and held down by a vacuum. The panel 110A is then inserted into the underside of the transparent holder insert 37A where it is held in place by a series of finger like cantilevered lugs 33A that project inward and downward. The lugs 33A are generally equally spaced around the periphery of the outer edge of the transparent holder insert 37A. The lugs 33A push on the curled edge 112A of the button panel 110A, disposing the button panel 110A upwards, pressing the outer edge 118A of the down button 114A tightly against the rib 35A at the outer edge of the contoured region 36A. With the button panel 110A and button 114A restrained so that the button 114A cannot pop up, the vacuum is released and the assembly fixture removed. With the button 114A held in its down position it can not contact the thick viscous non-drying ink 50A that was deposited on the concave surface 36A on the underside of the transparent holder. It is in this form that the closure is sent to the packer.

The packer applies the closure to a glass container containing a heated food product, typically using steam to flush air from the headspace prior to sealing the package. The package is then heat processed and cooled down, at which point an internal vacuum forms inside the sealed package. At this point both the vacuum and the rib 35A on the underside of holder 30A are both holding the button 114A down. The vacuum is also holding the button panel 110A onto the container. As the closure is removed, the 2-piece holder 30A moves upward in relation to the finish 22A, but because the vacuum is holding it, the button panel 110A does not move up. As the holder 30A and button panel 110A separate, the rib 35A on the underside of the holder 30A no longer presses on the edge of the button 114A to hold it down, leaving only the vacuum to prevent the button 114A from popping up. As the holder 30A is removed farther, the cantilevered lugs 33A apply an ever increasing force to the curl 112A of the button panel 110A, until eventually the force exceeds that which the vacuum is applying, and the seal between the button panel 110A and the container finish 22A is broken. With the seal broken, the pressures inside and outside the package equalize, and the button 114A reverts to its up position. With the button panel 110A now free to move, the cantilevered lugs 33A push the button panel upward until the up button 114A comes into contact with the thick viscous non-drying ink 50A on the underside of the contoured surface 36A, squeezing the ink 50A out, making the original pattern unrecognizable.

Figure 13:
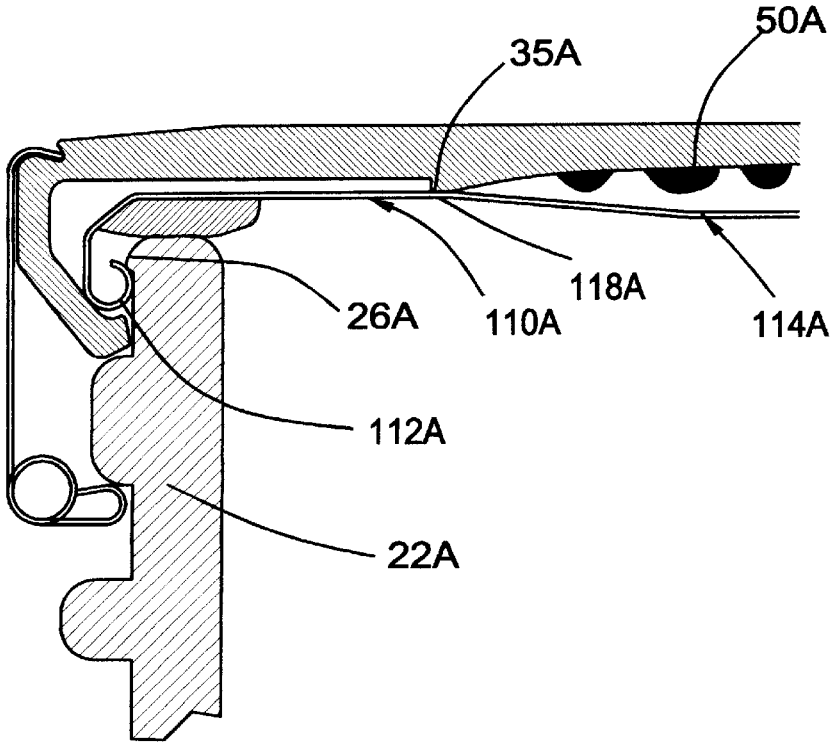
FIG. 13 is an enlarged view of another embodiment of the proposed closure that may be used on packages in which there is no internal vacuum, showing a lip on the edge of the sealing surface of the container.

As shown in FIG. 13, this embodiment can also be used for packages in which no vacuum exists by providing a lip 26A on the edge of the container finish 22A to engage the curl 112A on the button panel 110A. In this case the lip 26A on the container finish 22A delays the movement of the button panel 110A just as the vacuum did, allowing the button 114A to flip up and interact with the tamper-indicating element 50A as soon as the rib 35A and the edge 118A of the button 114A separate, after which, the curl 112A disengages the lip 26A and the closure can be completely removed.

Figure 14A:
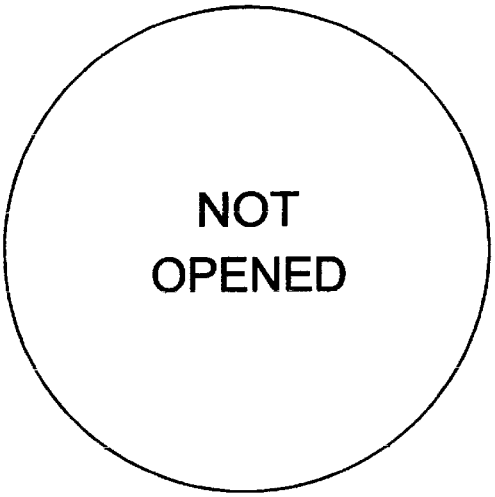
FIG. 14A and FIG. 14B are top views of the closures of FIG. 12 or 13 showing the change that occurs to a viscous ink tamper-indicating element used with these closures, before and after the packages have been opened, respectively.
Figure 14B:
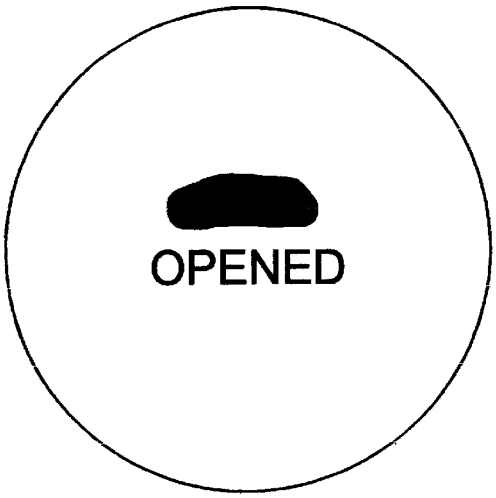

FIG. 14A and FIG. 14B respectively show how the tamper-indicating element appears before and after the package of FIG. 12 or 13 has been opened.

In FIG. 14A the word "NOT" is printed on the underside of the holder using a thick, viscous non-drying ink and the word "OPENED" is printed using a standard permanent ink.

FIG. 14B shows the result when the package is opened and the button pops up, obscuring the word "NOT", leaving only the word "OPENED", providing an unmistakable indication of the status of the package.

Figure 15A:
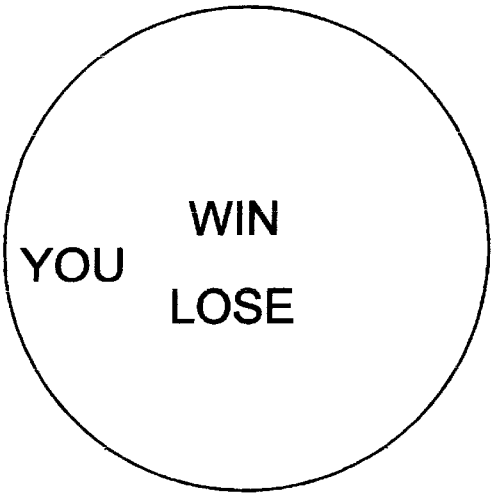
FIG. 15A and FIG. 15B are top views of the closure of FIG. 12 or 13 before and after the package is opened, showing how the non-drying thick viscous ink, tamper-indicating element can be used as a promotional feature for a package.
Figure 15B:
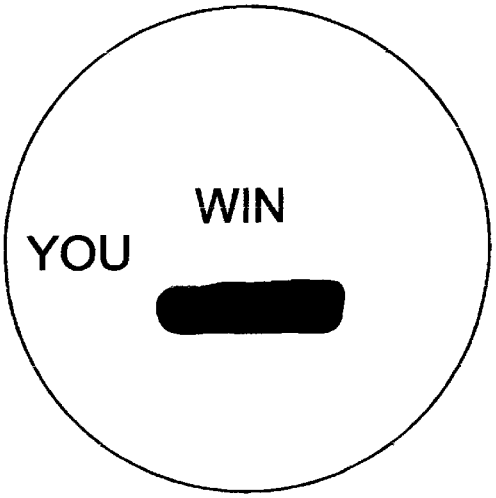

Another example is shown in FIG. 15A and FIG. 15B where the words "WIN" and "LOOSE" are printed on the underside of the holder, wherein only one of these two words will remain intelligible after the package has been opened. As shown in FIG. 15B, in this example the word "LOOSE" was obliterated when the package was opened and the button popped up, not only indicating that the package has been opened, but also graphically showing that the purchaser has won or become eligible to win a prize.

Conclusions, Ramifications and Scope

From the above detailed description, the reader will see that the tamper-evident closure of the invention provides a reliable indication of the first opening of a package that is simple, difficult to defeat, rugged, and that requires no action by the packer other than the application of the closure to the package.

While the above descriptions contain many specifics, these should not be construed as limitations on the scope of the invention, but rather as examples of the preferred embodiments thereof. Many other variations are possible. For example, the holder of the first embodiment could be made in two pieces, a transparent or translucent central panel to hold the indicator member, and an annular section that need not be transparent. The annular component holds the actuator panel and the button on the actuator panel down. It also comprises the vertical skirt with engageable threads for attachment of the closure to a container. By first assembling the actuator into the annular portion of the holder, there is no need for an assembly fixture since the button will be depressed when it is assembled into the holder before insertion of the indicator. After the actuator is inserted, the indicator and transparent center section of the holder can be inserted since the button is now in a down position and will not interact with the indicator. Mechanical means, an adhesive, or friction welding can be employed to permanently connect the two parts of the holder.

Other alternatives may be employed to hold the button down on the assembly fixture besides a vacuum or magnet. Among these are: formation of an integral mushroomed rivet or similar structure at the center of the underside of the button that can then be grasped and pulled down; or, adhesive attachment of an element to the underside of the button that can be grasped to pull the button down.

Examples of other indicator means that could be employed are brittle coatings applied directly to the top of the button. Inexpensive brittle resins like pine rosin, or a brittle wax can be melted and applied to the down button while on the assembly fixture. Upon cooling, these coatings become brittle, like the fully cured coating of the prior art U.S. Pat. No. 5,474,194 that was referred to earlier, and fracture when the button pops up. These coatings are cheaper, simpler to use, and produce the same effect as the curable coating of the prior art.

Although the embodiments detailed in this application refer to screw type closures, it should be understood that the present invention will work similarly for any closure in which a vertical separation of the closure and container takes place when the package is opened. Examples of other types of closures are: press-on pry-off closures; press-on twist-off closures; and hinged closures.

Although only the preferred embodiments of the invention are detailed herein, it should be obvious that a number of other configurations exist, whereby similar results would be obtained. Thus the scope of the invention should be determined by the appended claims and their legal equivalents, rather than by the examples given.

What I claim as my invention is:

1. A tamper-indicating closure comprising: a holder having a top panel and a skirt depending therefrom; an actuator attachable to said holder, said actuator having an outer portion, a deflectable portion which is deflectable from an upward position to a downward position relative to said top panel, and a deformable portion between said deflectable portion and said outer portion; engaging means for providing selective engagement between said top panel and said deflectable portion; retaining means on said skirt for engaging said outer portion of said actuator; and a tamper-indicating element positioned between said deflectable portion of said actuator and said top panel, whereby said deformable portion is deformed during attachment of said closure to a container, and remains deformed after removal of said closure from said container and said top panel and said deflectable portion deflects upwardly upon removal of said closure from said container.

2. A tamper-indicating closure as defined in claim 1, wherein said deformable portion comprises at least one hinged portion which is initially formed in an outward and downward configuration relative to said top panel and can be deformed to an outward and upward configuration relative to said top panel.

3. A tamper-indicating closure as defined in claim 2, wherein said holder further includes a thin web depending therefrom, said thin web capable of engaging said outer portion of said actuator.

4. A tamper-indicating closure as defined in claim 1, wherein at least a portion of said top panel is transparent, said tamper-indicating element comprising a brittle disk formed by compaction of a mixture of powders including inert filler materials from a group comprising calcium carbonate, talc, wood flour, mica, fly ash, powdered wood rosin and binders so that said brittle disk contrasts markedly with the color of said deflectable portion of said actuator.

5. A tamper-indicating closure as defined in claim 4, wherein said brittle disk includes interconnecting recessed grooves to facilitate and control the size of the fractured particles.

6. A tamper-indicating closure as defined in claim 1, wherein at least a portion of said top panel is transparent, said tamper-indicating element comprising a thick, viscous non-drying liquid deposited in a pattern to produce a word or icon on the underside of said top panel of said holder, said underside of said holder being formed with a profile resembling said deflectable portion when said deflectable portion is in said upward position.

7. A tamper-indicating closure as defined in claim 1, wherein said deflectable portion is provided in the center of said actuator.

8. A tamper-indicating closure as defined in claim 1, wherein said holder further includes a thin web depending therefrom, said thin web capable of engaging said outer portion of said actuator.

9. A tamper-indicating closure comprising: a holder having a top panel and a skirt depending therefrom; an actuator attachable to said holder, said actuator having an outer portion, a deflectable portion which is deflectable from an upward position to a downward position relative to said top panel, said deflectable portion being formed from a generally flat portion which is surrounded by at least one sloping portion; engaging means for providing selective engagement between said top panel and said deflectable portion, said engaging means being capable of engaging said at least one sloping portion, whereby engagement of said engaging means and said at least one sloping portion causes said flat portion to move away from said top panel such that said deflectable portion is in the downward position; a deformable portion between said deflectable portion and said outer portion; retaining means on said skirt for engaging said outer portion of said actuator; and a tamper-indicating element positioned between said deflectable portion of said actuator and said top panel, whereby said deformable portion is deformed during attachment of said closure to a container, and remains deformed after removal of said closure from said container and said top panel and said deflectable portion deflects upwardly upon removal of said closure from said container.

10. A tamper-indicating closure comprising: a holder having a top panel and a skirt depending therefrom; an actuator attachable to said holder, said actuator having an outer portion, a deflectable portion which is deflectable from an upward position to a downward position relative to said top panel; a rib provided between said top panel and said deflectable portion for providing selective engagement between said top panel and said deflectable portion; retaining means on said skirt for engaging said outer portion of said actuator; and a tamper-indicating element positioned between said deflectable portion of said actuator and said top panel and said deflectable portion deflects upwardly upon removal of said closure from said container.

11. A tamper-indicating closure comprising: a holder having a top panel and a skirt depending therefrom; an actuator attachable to said holder, said actuator having a portion which is deflectable from an upward position to a downward position relative to said top panel; engaging means for providing selective engagement between said top panel and said deflectable portion; a deformable portion between said deflectable portion and said outer portion; retaining means on said skirt for engaging an outer portion of said actuator, said retaining means comprising a plurality of lugs provided on said skirt; and a tamper-indicating element positioned between said deflectable portion of said actuator and said top panel, whereby said deformable portion is deformed during attachment of said closure to a container, and remains deformed after removal of said closure from said container and said top panel and said deflectable portion deflects upwardly upon removal of said closure from said container.

12. A tamper-indicating closure comprising: a holder having a top panel and a skirt depending therefrom; an actuator attachable to said holder, said actuator having an outer portion, a deflectable portion which is deflectable from an upward position to a downward position relative to said top panel, and a deformable portion between said deflectable portion and said outer portion; engaging means for providing selective engagement between said top panel and said deflectable portion; retaining means on said skirt for engaging said outer portion of said actuator; a sealing compound provided on said outer portion of said actuator; and a tamper-indicating element positioned between said deflectable portion of said actuator and said top panel whereby said deformable portion is deformed during attachment of said closure to a container and remains deformed after removal of said closure from said container, and said deflectable portion deflects upwardly upon removal of said closure from said container.

13. A tamper-indicating device comprising: a container; and a closure which is mounted on said container, said closure comprising a holder having a top panel and a skirt depending therefrom, an actuator attachable to said holder, said actuator having an outer portion, a deflectable portion which is deflectable from an upward position to a downward position relative to said top panel and a deformable portion between said deflectable portion and said outer portion, engaging means for providing selective engagement between said top panel and said deflectable portion, retaining means on said skirt for engaging said outer portion of said actuator, and a tamper-indicating element positioned between said deflectable portion of said actuator and said top panel, whereby said deformable portion is deformed during application of said closure to said container, and remains deformed after removal of said closure from said container and said top panel and said deflectable portion deflects upwardly upon removal of said closure from said container.

14. A tamper-indicating device as defined in claim 13, wherein said deformable portion comprises at least one hinged portion which is initially formed in an outward and downward configuration relative to said top panel and is deformed to an outward and upward configuration relative to said top panel when said closure is applied to said container.

15. A tamper-indicating device as defined in claim 14, wherein said holder further includes a thin web depending therefrom, said thin web engaging said outer portion of said actuator when said closure is applied to said container.

16. A tamper-indicating device as defined in claim 13, wherein said deflectable portion of said actuator is formed from a generally flat portion which is surrounded by at least one sloping portion, said engaging means engaging said at least one sloping portion, whereby engagement of said engaging means and said at least one sloping portion causes said flat portion to move away from said top panel such that said defectable portion is in the downward position.

17. A tamper-indicating device as defined in claim 13, wherein said engaging means comprises a rib provided on said top panel.

18. A tamper-indicating device as defined in claim 13, wherein said retaining means comprises a plurality of lugs provided on said skirt.

19. A tamper-indicating device as defined in claim 13, wherein at least a portion of said top panel is transparent, said tamper-indicating element comprising a brittle disk formed by compaction of a mixture of powders including inert filler materials from a group comprising calcium carbonate, talc, wood flour, mica, fly ash, powdered wood rosin and binders so that said brittle disk contrasts markedly with the color of said deflectable portion of said actuator.

20. A tamper-indicating device as defined in claim 19, wherein said brittle disk includes interconnecting recessed grooves to facilitate and control the size of the fractured particles.

21. A tamper-indicating device as defined in claim 13, wherein at least a portion of said top panel is transparent, said tamper-indicating element comprising a thick, viscous non-drying liquid deposited in a pattern to produce a word or icon on the underside of said top panel of said holder, said underside of said holder being formed with a profile resembling said deflectable portion when said deflectable portion is in said upward position.

22. A tamper-indicating device as defined in claim 13, further including a sealing compound provided on said outer portion of said actuator for engagement with said container when said closure is applied thereto.

23. A tamper-indicating device as defined in claim 13, wherein said deflectable portion is provided in the center of said actuator.

24. A method of forming a tamper-indicating closure comprising the steps of:

providing a holder having a top panel and a skirt depending therefrom, said top panel having retaining structure thereon;

providing an actuator having an outer portion, a deflectable portion which is deflectable from an upward position to a downward position relative to said top panel, and a deformable portion between said deflectable portion and said outer portion, whereby said deformable portion is deformed during application of said closure to a container, and remains deformed after removal of said closure from said container and said deflectable portion deflects upwardly upon removal of said closure from said container;

providing engaging structure between said top panel and said deflectable portion;

providing a tamper-indicating element;

depressing said deflectable portion to said downward position; and thereafter engaging said holder and said tamper-indicating element with said actuator such that said tamper-indicating element is between said downwardly positioned deflectable portion and said holder, thereby engaging said engaging structure between said deflectable portion and said top panel and engaging said ret structure with said outer portion of said actuator.

25. A method of forming a tamper-indicating device comprising the steps of:

providing a holder having a top panel and a skirt depending therefrom, said top panel having retaining structure thereon;

providing an actuator having an outer portion and a deflectable portion which is deflectable from an upward position to a downward position relative to said top panel, and a deformable portion between said deflectable portion and said outer portion thereof;

providing engaging structure between said top panel and said deflectable portion;

providing a tamper-indicating element;

depressing said deflectable portion to said downward position;

thereafter engaging said holder and said tamper-indicating element with said actuator such that said tamper-indicating element is between said downwardly positioned deflectable portion and said holder, thereby engaging said engaging structure between said deflectable portion and said top panel and engaging said retaining structure with said outer portion of said actuator;

providing a container; and attaching said assembled holder, tamper-indicating element and actuator to said container, whereby said container engages against said outer portion of said actuator and deforms said deformable portion, whereby said deformable portion remains deformed after removal of said closure from said container, whereby said deflectable portion deflects upwardly, not necessarily due to a loss of vacuum within said container and said top panel and said deflectable portion deflects upwardly upon removal of said closure from said container.

* * * * *